United States Patent [19]

Müller et al.

[11] Patent Number: 4,670,727

[45] Date of Patent: Jun. 2, 1987

[54] ELECTROMAGNETIC RELAY

[75] Inventors: Erwin Müller, Munich; Alois Ruhland, Oberhaching, both of Fed. Rep. of Germany

[73] Assignee: Siemens Aktiengesellschaft, Berlin and Munich, Fed. Rep. of Germany

[21] Appl. No.: 884,456

[22] Filed: Jul. 11, 1986

[30] Foreign Application Priority Data

Jul. 18, 1985 [DE] Fed. Rep. of Germany ..... 3525716

[51] Int. Cl.[4] ..... H01F 7/13

[52] U.S. Cl. ..... 335/274; 335/276

[58] Field of Search ..... 335/270, 271, 274, 275, 335/276

[56] References Cited

U.S. PATENT DOCUMENTS

| | | | |
|---|---|---|---|
| 1,577,031 | 3/1926 | Kaisling | 335/276 |
| 3,117,255 | 1/1964 | Peterson | 335/274 |
| 3,821,674 | 6/1974 | Aidn et al. | 335/270 |
| 4,338,585 | 7/1982 | Volke | 335/276 X |
| 4,439,750 | 3/1984 | Fujii et al. | 335/274 |

FOREIGN PATENT DOCUMENTS

| | | | |
|---|---|---|---|
| 8235283 | 6/1983 | Fed. Rep. of Germany . | |
| 6613165 | 3/1968 | Netherlands | 335/274 |
| 1439425 | 6/1976 | United Kingdom . | |

*Primary Examiner*—George Harris

*Attorney, Agent, or Firm*—John Francis Moran

[57] ABSTRACT

The relay has a flat armature (6) carried at one bearing edge (15) of a yoke arm (5*a*), which is attached via an armature retaining spring (8). In order to protect the armature against shocks, the exposed section (18) of the armature retaining spring (8) engages with one or several extensions (6*a*) of the armature. In the event of shocks occurring in the direction parallel to the coil axis, the armature is only able to move slightly and then it knocks against the terminal edges (16) of the exposed spring sections (18).

14 Claims, 5 Drawing Figures

ELECTROMAGNETIC RELAY

BACKGROUND OF THE INVENTION

The present invention relates to electromagnetic relays, and it relates, more particularly, to a relay arrangement wherein means is provided for protecting against undesired lift-offs from the yoke when the arrangement is subject to mechanical shocks.

A conventional relay of this type is described in German Patent Document DE-GM 82 35 283. The problem common to this and other such relays is that the armature is held in the bearing only by the relatively soft leaf spring and is ejected from the bearing by vibrations and shocks, at which time the relay may get stuck at the relay housing or deform the leaf spring. Consequently, safe operation can therefore no longer be ensured for specific applications.

As a solution for this problem, it has already been proposed that the armature and the yoke be provided with interlocking projections and tripping mechanisms, so as to protect the armature against excessive lift-off from the bearing. But there is also in this case the possibility that the armature may get stuck during strong shocks, which can at best be prevented by using components of complicated design. The application of additional safety elements would increase the production costs for the relay to an unacceptable level.

SUMMARY OF THE INVENTION

Therefore, it is an object of the present invention to so provide a relay of the type mentioned above having an armature protected against an undesirable lift-off from the yoke during shocks without employing additional conponents, while using bearing elements of a relatively simple design.

According to the present invention, this is achieved by a design wherein the outside edge of the armature in the region of the bearing location has at least one projection extending beyond the bearing edge, intersecting the plane of the first spring arm and engaging with at least one correspondingly exposed section of the first spring arm, whereas the outside edge of the exposed spring section runs parallel to the armature surface and serves as a support for said armature in the event of an undue movement occurring in the opposite direction of the bearing edge.

The section of the first spring arm which is exposed for the purpose of intercepting the armature is located in the region extending parallel to the yoke beyond the bearing location, while, in the event of the armature being subjected to percussive movements, the armature moves precisely in the direction of the first spring arm and impacts at the outside edge of the exposed spring section. In this direction, i.e. longitudinally to the spring, the spring can absorb high tensile forces without deformations. During a percussive movement in the direction of the yoke arm, the armature is thus retained reliably by the leaf spring.

In order to allow for unavoidable tolerances and not to impede movements in the armature during standard switching operations, it is expedient to provide a gap between the outside edge of the exposed spring section and the armature surface, which corresponds to the greatest permissible movement of the armature from the bearing. In a preferred illustrative embodiment of the present invention, the first spring arm is provided at each lateral edge with a respective exposed lug-shaped section which respectively engages with a lateral projection of the armature. In another advantageous illustrative embodiment, the exposed spring section is developed as a window-shaped recess of the leaf spring which engages with the lug-shaped extension of the armature. In each of these embodiments, the outside edge of the exposed spring section can also be provided at a lobe which is exposed at both ends and may be bent outward from the plane of the spring arm. In this case, the abovementioned distance between the outside edge and armature surface may be reduced by bending the lobe if necessary.

In a further embodiment of the invention, a lug-shaped boss may be punched at the armature side opposite the yoke, which has a given gap opposite the bearing edge of said yoke and props itself against said yoke in the event that the armature is subjected to shocks occurring in its longitudinal direction. By this technique, the armature is protected against shocks from movements occurring vertically to the yoke plane.

Other features and advantages of the invention will be apparent from the following description of the preferred embodiments, and from the claims.

For a full understanding of the present invention, reference should now be made to the following detailed description of the preferred embodiments of the invention and to the accompanying drawings.

DETAILED DESCRIPTION

Figure 1:
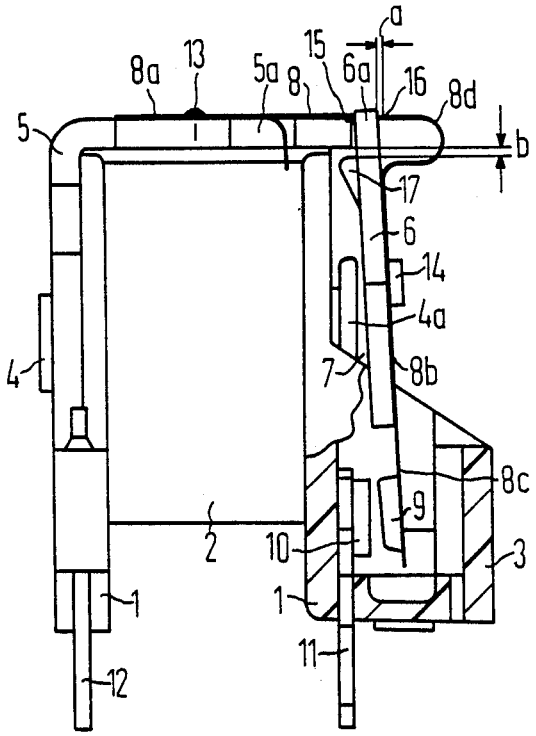
FIG. 1 shows a lateral view of the relay developed according to the invention, which in part is shown as a sectional view.

The relay shown in FIG. 1 has as a base a spool 1 which carries a winding 2 and is provided at a flange with a pocket-shaped extension 3 for accommodating a set of contacts. The magnetic system is formed by a core 4, an angular yoke 5 and a plate-shaped armature 6, the latter forming a working gap 7 with a widened pole end 4*a* of the core 4. A yoke arm 5*a* extending above the coil winding in parallel to the coil axis carries an armature retaining spring 8 with a first spring arm 8*a* supported by the yoke arm 5*a* and a second spring arm 8*b* supported by the armature. With its extension 8*c*, the armature retaining spring 8 serves at the same time as a contact spring which extends into the pocket-shaped extension 3 of the spool 1, where it carries a contact member 9 which interacts with a contact element for the armature retaining spring or contact spring 8 leads, in a manner not shown herein, from the spring arm 8*a* to the connecting side of the relay. Further the relay is provided in the usual manner with coil connecting pins 12.

The first spring arm 8*a* of the armature retaining spring 8 is welded or riveted to the yoke arm 5*a* at the fastening location 13, and the second spring arm 8*b* is welded or riveted to the armature 6 at the fastening location 14. Between the two armature arms 8*a* and 8*b* there is provided a curved center section 8*d* which first runs as a straight-line extension of the first armature arm in parallel to the yoke arm 5*a* beyond a bearing edge 15 which is developed as such at said yoke arm. Then center section 8*d* is curved toward the armature surface, and finally passes over to the second spring arm 8*b*. In the bearing region, the armature plane intersects the plane of the first spring arm 8*a* or the center section 8*d*, whereas an exposed section of the armature retaining spring 8 engages with one or several projections 6*a* of the armature. This ensures that, in the event of shocks, the armature cannot lift off from the bearing edge 15 in the direction parallel to the coil axis. The outside edge 16 of the exposed spring section has a gap, designated with reference symbol a, opposite the armature surface, which limits the highest permissible mobility of the armature in the aforesaid direction in parallel to the coil axis. The design of the armature retaining spring 8 and of the armature located in the bearing region is described in detail in the following with reference to the drawings.

In order also to prevent a movement in the event of a shock occurring vertically to the coil axis, a lug 17 is punched at the armature on the side facing the coil, so that during corresponding shocks said lug stops at the yoke arm 5*a* and thus prevents a further movement of the armature. Opposite the underside of the yoke arm 5*a*, said lug 17 has a gap, designated with reference symbol b. This gap determines the greatest permissible movement of the armature in an vertical direction to the coil axis (toward the top of the drawing). Even taking into consideration production tolerances, the gaps a and b ensure that the normal control movement of the armature is not hindered by undue high friction.

Figure 2:
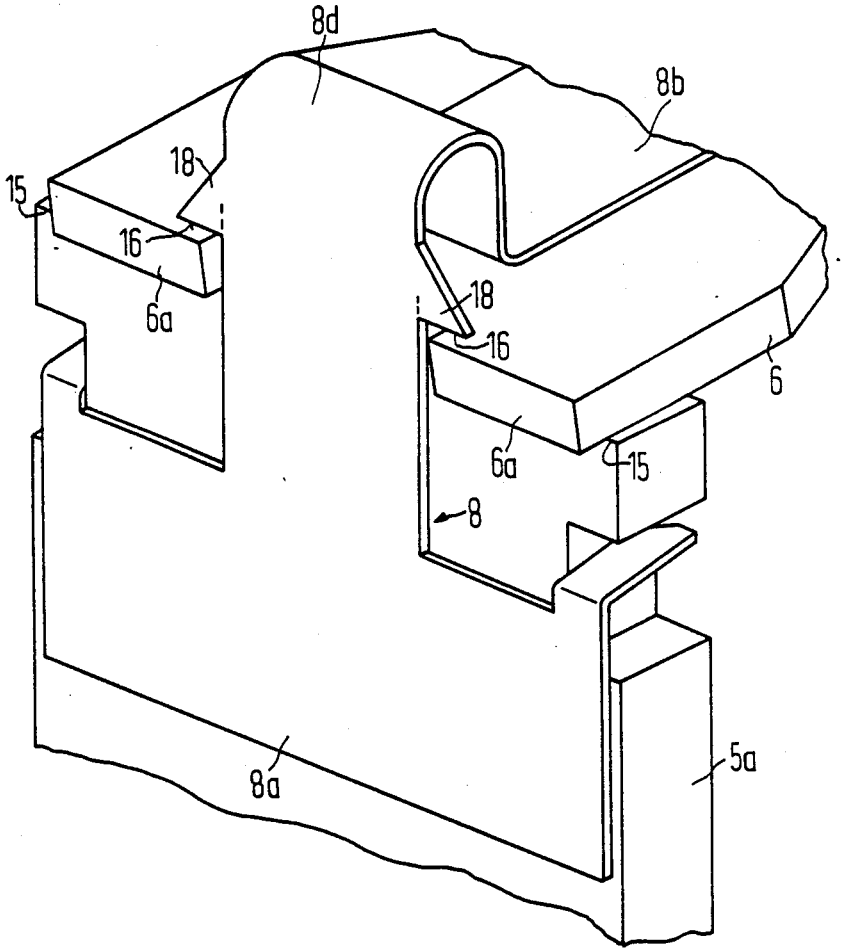
FIG. 2 shows an enlarged perspective view of the bearing region of the relay.

In FIG. 2, the bearing location of the relay described above with reference to FIG. 1 is shown in a perspective view. The armature 6 located on the yoke edge 15 is provided at both sides of the center section 8*d* of the armature retaining spring 8 with an extension 6*a* whose plane intersects the plane of the armature retaining spring in this region. The armature retaining spring has exposed sections at both sides in the from of intercepting lugs 18 whose undersides respectively from the abovementioned outside edge 16. Said outside edge 16 runs in parallel to the surface of the armature 6 or the armature extensions 6*a*. Opposite said outside edge there is located a gap, designated again with reference symbol a, since it is similar to the one shown in FIG. 1. In the event of shocks occurring in the direction parallel to the coil axis, the armature knocks against the intercepting lugs 18 and is thus prevented from moving from the bearing beyond the gap a.

Figure 3:
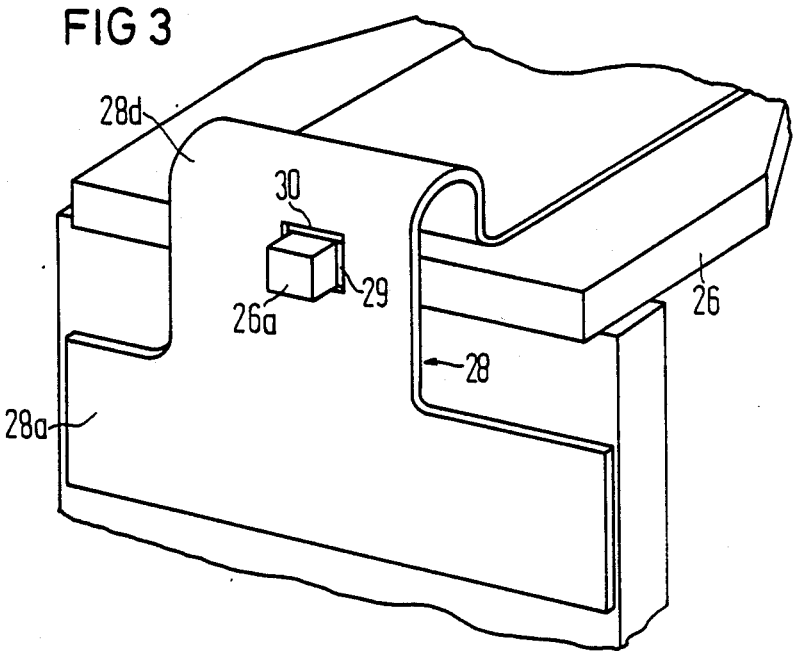
FIGS. 3 and 4, which are comparable to FIG. 2, show further embodiments of the bearing region of the relay.

It is, of course, possible to modify the design of the engaging components of the armature retaining spring and the armature. FIG. 3, therefore, shows an armature retaining spring 28 which in its center section 28*d* has an exposed section in the form of a window-shaped recess 29 with which the lug-shaped extension 26*a* of the armature 26 engages. In this instance, the edge 30 already is spaced by abovementioned gap a, from the surface of the lug 26*a*, so as to limit the movement of the armature as in the previous example.

Figure 4:
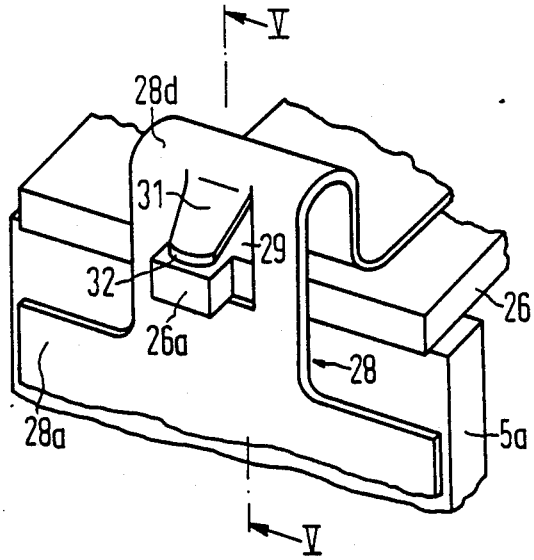
Figure 5:
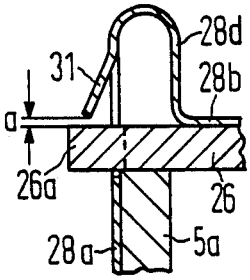
FIG. 5 shows a cross-sectional view V—V from FIG. 4.

FIG. 4 shows a further improvement of the embodiment illustrated in FIG. 3. The window-shaped recess 29 of the armature retaining spring 28 is provided with an exposed lobe 31 which, at the underside of said lobe, forms an outside edge 32 as a stop for the armature lug 26*a*. The lobe 31 can be bent outward, so as to set the gap, designated with reference letter a, at the desired dimension. This is again shown in the cross-sectional drawing of FIG. 5.

It is to be understood that the foregoing embodiments are merely illustrative of the invention and that various modifications and changes may be made without departing from the scope of the invention. Accordingly, it is to be understood that the invention is only limited by the scope of the appended claims.

What is claimed is:

1. An electromagnetic relay comprising: a coil; a flat yoke arm extending adjacent to the coil parallel to the coil axis; an armature, also flat, arranged with the front end in front of the coil and carried at the bearing edge of the yoke arm; as well as an armature retaining spring developed as a leaf spring with two arms which besically run at right angles to each other, while the first arm of said armature retaining spring is supported flat by the yoke arm, is attached to said yoke arm, extends beyond the bearing edge, and runs with a curved center section around the bearing location to the armature surface, and the second arm is attached flat to the armature, the armature (6; 26) in the area of the bearing location has at least one projection (6*a*; 26*a*) projecting beyond the bearing edge (15), intersecting the plane of the first spring arm (8*a*; 28*a*) and engaging with at least one correspondingly exposed section (18; 29) of the first spring arm, while the terminal edges (16; 30; 32) of the exposed spring section run parallel to the armature surface and serve as support for said armature (6; 26) in the event of a movement occuring in the opposite direction of the bearing edge (15).

2. A relay as defined in claim 1, characterized by each outside edge (16; 30; 32) of the exposed spring section (18; 29) respectively has a given gap (a) opposite the surface of the armature projection (6*a*; 26*a*).

3. A relay as defined in claim 1, characterized by the first spring arm (8*a*; 28*a*) at both lateral edges respectively has a lug-shaped intercepting section (18) which respectively engages with a lateral projection (6*a*) of the armature.

4. A relay as defined in claim 2, characterized by the first spring arm (8*a*; 28*a*) at both lateral edges respectively has a lug-shaped intercepting section (18) which respectively engages with a lateral projection (6*a*) of the armature.

5. A relay as defined in claim 1, characterized by the exposed spring section is developed as a window-shaped recess (29) of the leaf spring (28) which engages with a lug-shaped extension (26*a*).

6. A relay as defined in claim 2, characterized by the exposed spring section is developed as a window-shaped recess (29) of the leaf spring (28) which engages with a lug-shaped extension (26*a*).

7. A relay as defined in claim 1, characterized by the outside edge (32) of the exposed spring section (29) is provided at a lobe (31) which is exposed at both sides and can be bent outward from the plane of the spring arm (28*a*).

8. A relay as defined in claim 2, characterized by the outside edge (32) of the exposed spring section (29) is provided at a lobe (31) which is exposed at both sides and can be bent outward from the plane of the spring arm (28*a*).

9. A relay as defined in claim 3, characterized by the outside edge (32) of the exposed spring section (29) is provided at a lobe (31) which is exposed at both sides and can be bent outward from the plane of the spring arm (28*a*).

10. A relay as defined in claim 5, characterized by the outside edge (32) of the exposed spring section (29) is provided at a lobe (31) which is exposed at both sides and can be bent outward from the plane of the spring arm (28*a*).

11. A relay as defined in claim 1, characterized by a lug (17) is punched at the side of the armature (6) opposite the yoke, which knocks against the yoke (5) in the event of movement of the armature in the vertical direction of the coil axis.

12. A relay as defined in clam 2, characterized by a lug (17) is punched at the side of the armature (6) opposite the yoke, which knocks against the yoke (5) in the event of movement of the armature in the vertical direction of the coil axis.

13. A relay as defined in claim 5, characterized by a lug (17) is punched at the side of the armature (6) opposite the yoke, which knocks against the yoke (5) in the event of movement of the armature in the vertical direction of the coil axis.

14. A relay as defined in claim 7, characterized by a lug (17) is punched at the side of the armature (6) opposite the yoke, which knocks against the yoke (5) in the event of movement of the armature in the vertical direction of the coil axis.

* * * * *